United States Patent [19]

Busselet

[11] 4,349,135

[45] Sep. 14, 1982

[54] AEROSOL CONTAINER VALVE MOUNTING

[75] Inventor: Jean-Claude G. Busselet, Le Neubourg, France

[73] Assignee: Establissements Valois, Le Neubourg, France

[21] Appl. No.: 126,757

[22] Filed: Mar. 3, 1980

[30] Foreign Application Priority Data

Mar. 8, 1979 [FR] France ..... 79 05937

[51] Int. Cl.[3] ..... B65D 83/14

[52] U.S. Cl. ..... 222/394

[58] Field of Search ..... 222/402.1, 402.2, 402.24, 222/402.25, 321, 340, 320, 341, 383–385, 394, 396, 397, 398, 402.19

[56] References Cited

U.S. PATENT DOCUMENTS

| | | | |
|---|---|---|---|
| 3,143,253 | 8/1964 | Lindgren et al. | 222/396 |
| 3,596,808 | 8/1971 | Corsette | 222/385 |
| 3,722,759 | 3/1973 | Rodden | 222/396 |
| 3,756,465 | 9/1973 | Meshberg | 222/402.2 X |

*Primary Examiner*—Stanley H. Tollberg

*Attorney, Agent, or Firm*—Sughrue, Mion, Zinn, Macpeak & Seas

[57] ABSTRACT

A nylon or similar material ring insensitive to a product stored in a container is disposed imperviously between a valve and the inner wall of the container so as to protect the sealing gasket against chemical reactions with the stored product.

2 Claims, 2 Drawing Figures

AEROSOL CONTAINER VALVE MOUNTING

BACKGROUND OF THE INVENTION

1. Field of the Invention

The invention relates to a hand actuated aerosol assembly and relates more specifically to a mounting or fixing device for a valve or a pump on a container of said aerosol type.

The invention can be used with any size of such containers and relates to glass or plastic containers as well as to metal cans.

2. Description of the Prior Art

One of the problems to be considered in the fixation of such an assembly is the sealing thereof, since, more especially in the case of valves, there prevails permanently iside the container a pressure high enough for expelling the content and spraying the product. Until now, secure sealings have been made of various gasket materials, such as natural or synthetic rubber, or similar products, provided they are flexible enough.

Unfortunately, such containers may be filled with products which are incompatible with the usual gasket materials. For example, perfumes, cosmetics, medicines and drugs, insecticides, and the like, may comprise components which react with the gasket. The gasket may then absorb or fix the component and swell or fissure or split, or be otherwise damaged. It ensues that the assembly is no longer securely sealed. It is also possible that exchanges from the gasket into the liquid may occur, whereby the liquid is then altered and can lose its qualities. As the containers remain stocked or stored for a long time, this drawback may be serious even if the reaction with the gasket is slow.

Some materials, such as nylon or Teflon, are fairly resistent to common chemicals, but they are not flexible nor resilient enough to provide a desirable sealing because of the insufficient precision and strength of this type of container, since only the packing is to be considered, the container being discarded after use.

SUMMARY OF THE INVENTION

According to the invention, there is provided a fixing device for a valve on an aerosol container assembly, said device comprising a ring or annular gasket, made of a material resistent to chemicals disposed around the valve, inside the neck of the container, forming an impervious barrier between the valve and the inner wall of the container neck. Preferably, so as to sustain pressure, said ring is applied against the cap or against the sealing gasket, which is itself applied outwardly against the cap. Materials which can be used for manufacturing said ring are somewhat flexible so that a seal can be provided if the ring is of a sufficient axial length (thickness) so as to have proper contact along the valve and the neck of the container.

According to another feature of the invention, the shape or form of the ring may be chosen so as to fill a space adjacent to the gasket, thereby allowing the container to be completely emptied through the lateral opening used for the filling of the container.

BRIEF DESCRIPTION OF THE DRAWING

Various objects, features and attendant advantages of the present invention will be more fully appreciated as the same becomes better understood from the following detailed description of the present invention when considered in connection with the accompanying drawings.

DETAILED DESCRIPTION OF THE PREFERRED EMBODIMENT

Figure 1:
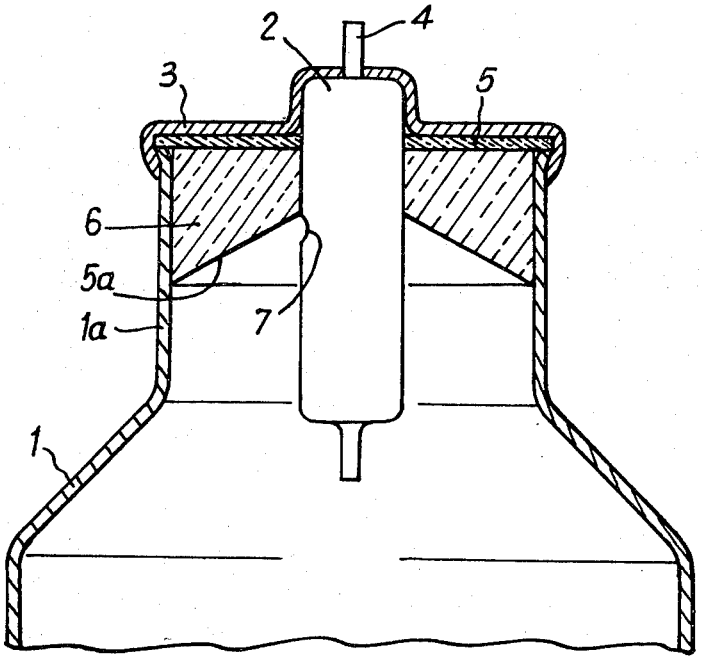
FIG. 1 is an axial section showing the neck of a container fitted with a valve (or pump)

A container or bottle 1 is fitted with a valve 2 fixed onto the container by means of a cap 3, set on the neck 1*a* of container 1 with the interposition of a rubber gasket 5. Only the outside shape of the valve is shown. It is well understood that the invention can be used with every type of valve, or hand actuated pump. The outlet tube 4 extends through the center of cap 3 in a conventional manner, with a suitable fluid seal (not shown). Gasket 5 is provided for fluid sealing between the cap and the container and as the case may be, between the valve body and the cap. This gasket 5 can be made of natural or synthetic rubber or any similar material suitable for ensuring sealing.

Figure 2:
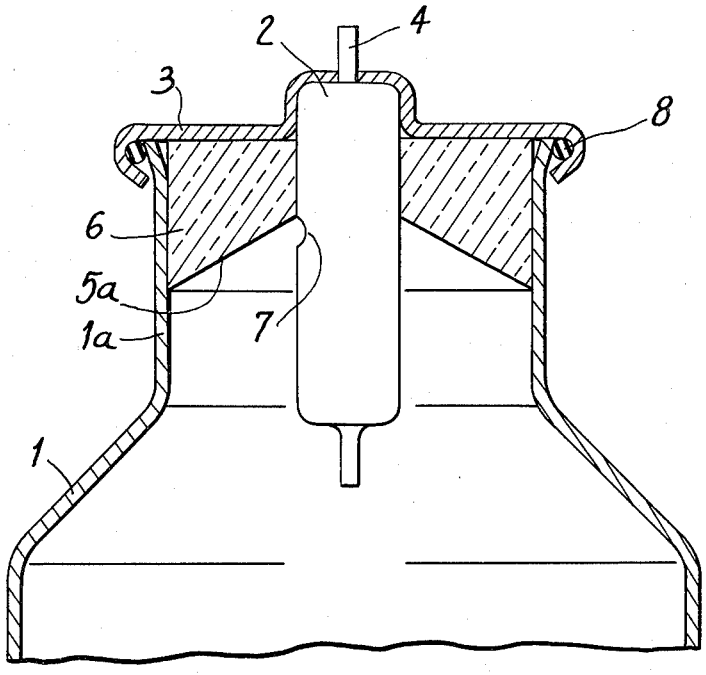
FIG. 2 is a similar section illustrating a modification of the sealing gasketing.

According to the invention, there is provided a ring 6 between valve 2 and neck 1*a* of container 1. Said ring can be made of nylon for example or of another suitable material which is insensitive to the fluid stored in the container. As this ring has a relatively low flexibility, it is forced around the valve body and is sufficiently long to ensure isolation of the gasket, taking into account the low resilience and the fact that the closure of gasket 5 is completely impervious. In the same manner, the ring is forced inside the container, which can either be a metal can or a plastic or glass bottle. The length of the ring, because of the clamping, improves the holding of the valve in the container neck. The ring 6 is preferably applied against gasket 5 since it is exposed to the pressure inside the container and said pressure can be high. In some cases, as shown in FIG. 2, the gasket 5 is an O-ring disposed outside the container under the turned back edge of cap 3, forming the setting fixation. Ring 5 is used with the same advantage and in this case is disposed directly against the inside wall of cap 3.

In the Figures, the ring is shown with an inner conical surface 5*a*, the upper edge of which is in abutment with valve 2, above the aperture 7 of the filling passage of the valve (or pump). This disposition enables to empty the container to be completely emptied through said filling aperture 7 when the by holding same downwardly with the neck. The inside surface can be differently shaped, e.g. hemispheric, and still have the same advantages.

The fluid sealing so obtained between ring 6 and valve 2 on the one hand and between ring 6 and the inside wall 1*a* of the container on the other hand, precludes the contained product from coming into contact with neck gasket 5. Chemical exchanges are thus impossible, either from rubber into the product or by fixation or absorption of the product by the gasket.

While the invention has been disclosed with reference to one preferred embodiment, it is understood that modifications and changes will become apparent to those ordinary skilled in the art and the present invention is intended to cover all such obvious modifications and changes which fall within the spirit and scope of the invention as defined in the appended claims.

What is claimed as new and desired to be secured by Letters Patent of the United States is:

1. A hand actuated aerosol spraying device comprising; a container with a neck at one end and an aperture at the same end, a valve disposed in the neck with an outlet tube projecting outside the container, a cap closing the container and holding the valve in position inside the neck, said cap being provided with an orifice for the outlet tube, a sealing gasket being disposed between the cap and the container for preventing fluid leakage, wherein there is provided in the container neck between the valve and the inner wall of the container neck a ring made of a material insensitive to the product stored in the container, said ring forming an impervious bar between the valve and the container inner wall so as to prevent the stored product from reaching the gasket, wherein said gasket is a flat washer, and said ring bears against said cap through said gasket, and wherein the axial surface of the ring, opposite to the cap, is of a generally conical form, the axial length of the ring being shorter toward the container axis, and the inner circumferential edge of said ring being adjacent a filling orifice in the valve, whereby, when said container is inverted, said product may be completely exhausted therefrom, via said conical surface and said orifice.

2. A hand actuated aerosol spraying device comprising; a container with a neck at one end and an aperture at the same end, a valve disposed in the neck with an outlet tube projecting outside the container, a cap closing the container and holding the valve in position inside the neck, said cap being provided with an orifice for the outlet tube, a sealing gasket being disposed between the cap and the container for preventing fluid leakage, wherein there is provided in the container neck between the valve and the inner wall of the container neck a ring made of a material insensitive to the product stored in the container, said ring forming an impervious bar between the valve and the container inner wall so as to prevent the stored product from reaching the gasket, wherein the gasket is an O-ring disposed at an inner peripheral surface of the radially outer portion of the cap, and said ring bears directly against the cap, and wherein the axial surface of the ring, opposite to the cap, is of a generally conical form, the axial length of the ring being shorter toward the container axis, and the inner circumferential edge of said ring being adjacent a filling orifice in the valve, whereby, when said container is inverted, said product may be completely exhausted therefrom, via said conical surface and said orifice.

* * * * *